United States Patent [19]

Elzey

[11] Patent Number: 4,927,023

[45] Date of Patent: May 22, 1990

[54] SPACER MEMBER AND METHOD OF FORMING THE SAME

[75] Inventor: Paul B. Elzey, Kalamazoo, Mich.

[73] Assignee: EFP Corporation, Elkhart, Ind.

[21] Appl. No.: 843,015

[22] Filed: Mar. 24, 1986

[51] Int. Cl.[5] ..... B65D 81/02

[52] U.S. Cl. ..... 206/523; 206/586

[58] Field of Search ..... 206/523, 586

[56] References Cited

U.S. PATENT DOCUMENTS

| | | | |
|---|---|---|---|
| 3,411,978 | 11/1968 | Frohbach et al. | 206/460 |
| 3,420,364 | 1/1969 | Kennedy, Jr. | 206/460 |
| 3,530,213 | 9/1970 | Belle Isle | 206/523 |
| 3,580,469 | 5/1971 | Reese | 206/523 |
| 3,725,188 | 4/1973 | Kalt | 206/523 |
| 4,093,493 | 6/1978 | Welch et al. | 206/460 |
| 4,413,735 | 11/1983 | Little | 206/523 |

*Primary Examiner*—Joseph Man-Fu Moy

*Attorney, Agent, or Firm*—Thomas J. Dodd

[57] ABSTRACT

A spacer member is adhered to a tape having adhesives at opposite faces thereof and a release layer is adhered to the first named tape to releasably connect multiple spacer members and expose adhesive at one face for adhering a spacer member to a fragile object upon removal of the release layer. The method includes forming spacer members of selected size from a large foam panel. One face of an adhesively coated tape is adhered to the panel and a release layer is adhered to the opposite face of the tape web, after which spacer members of selected size and shape are formed by cutting through the panel and the tape web without severing the release layer.

1 Claim, 2 Drawing Sheets

Fig. 3
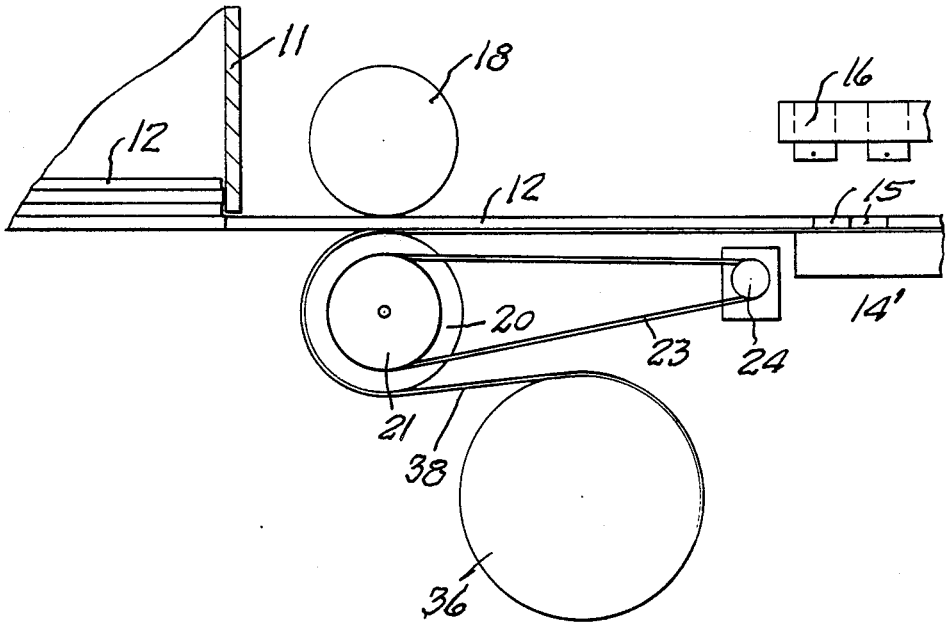
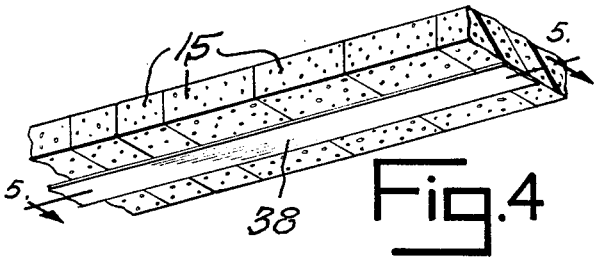
Fig. 4
Fig. 5
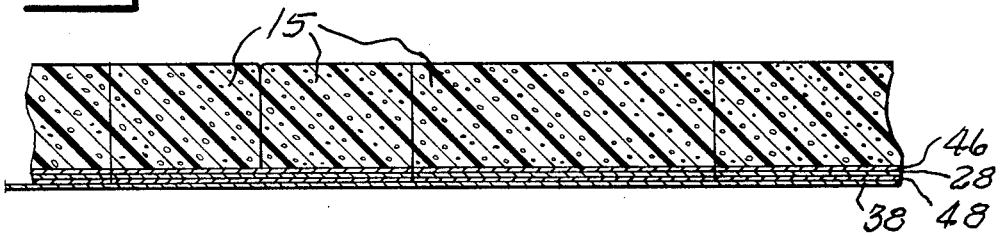
Fig. 6
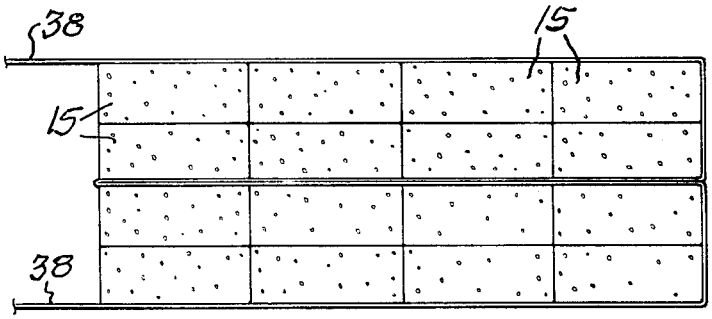

SPACER MEMBER AND METHOD OF FORMING THE SAME

SUMMARY OF THE INVENTION

This invention relates to spacers and will have application to foam spacers for fragile objects, and to the method of forming the spacers.

Fragile objects, such as glass objects of selected size and shape which are normally shipped in substantial quantities from the manufacturer to the user, require preparation for shipment by insertion of spacer members between adjacent objects in a shipping container. The application of spacer members between such objects as automobile windshields requires accuracy of application of the spacer members to ensure protection of such objects during shipment. The application of the spacer member to a fragile object may be accomplished by hand or by means of a robot. In either instance, ready location of spacer members relative to an object to which they are being applied is important to minimize the time required for application of the spacer members to successive objects which are being assembled for shipment. Accommodation for ready release of the spacer members from a group is also required as individual fragile objects of a shipment are being installed successively at a point of use.

It is the primary object of this invention to provide a method and means for forming spacer members of selected size and shape which may be adapted for a releasable application to a fragile object at selected positions on said fragile object.

A further object is to provide a method of forming and assembling spacer members by applying an adhesive coated strip or tape to a sheet or panel of material from which the spacer members are to be cut into the desired shape and size in a manner which ensures that said adhesive tape has adhered to each member and for an assembly of connected spacer members.

A further object is to provide a method of forming an assembly of spacer members connected by a flexible strip or tape adhered thereto which facilitates a releasable connection of multiple spacer members in a manner which permits compact shaping of the assembly of the connected members in a storage container and permits individual spacer members to be consecutively removed from the assembly at a point of application thereof.

A further object is to provide means for storing and consecutively advancing large panels of spacer members to a position where a flexible adhesive strip or tape which has opposed adhesive coatings and an outer release member can be applied to the panels at selected positions.

A further object is to provide means for severing spacer members of desired shape and size from each spacer panel without severing the release member.

Other objects will be apparent from the following specification.

BRIEF DESCRIPTION OF THE DRAWING

FIG. 3 is an enlarged fragmentary schematic side view of the apparatus.

FIG. 4 is a fragmentary perspective view of assembled spacer members.

FIG. 5 is a fragmentary sectional view of an assembly of spacer members taken along line 5—5 of FIG. 4.

FIG. 6 is a side view of an assembly of connected spacer members arranged for packaging or storage.

DESCRIPTION OF THE PREFERRED EMBODIMENT

Figure 1:
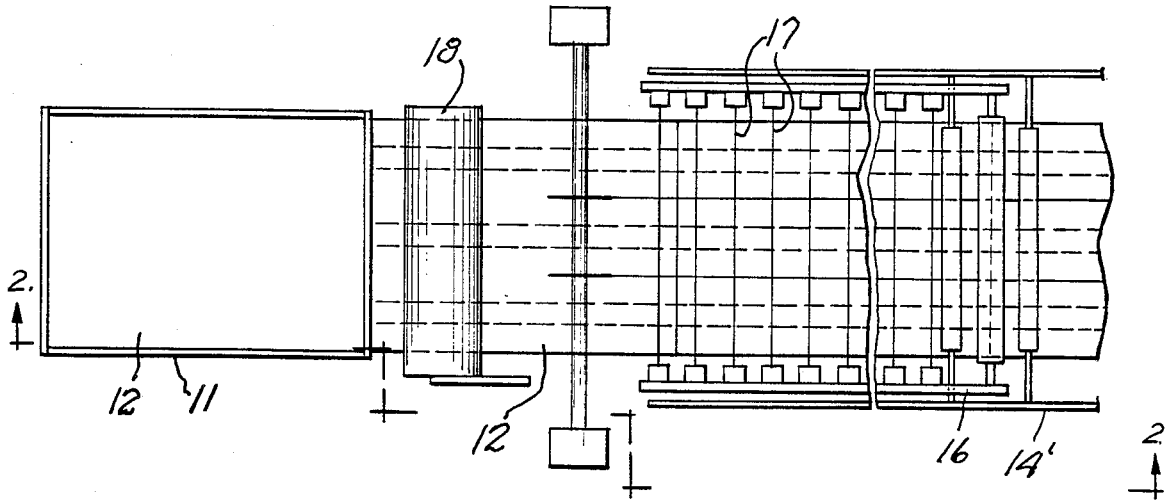
FIG. 1 is a schematic top plan view of the forming and assembling apparatus.
Figure 2:
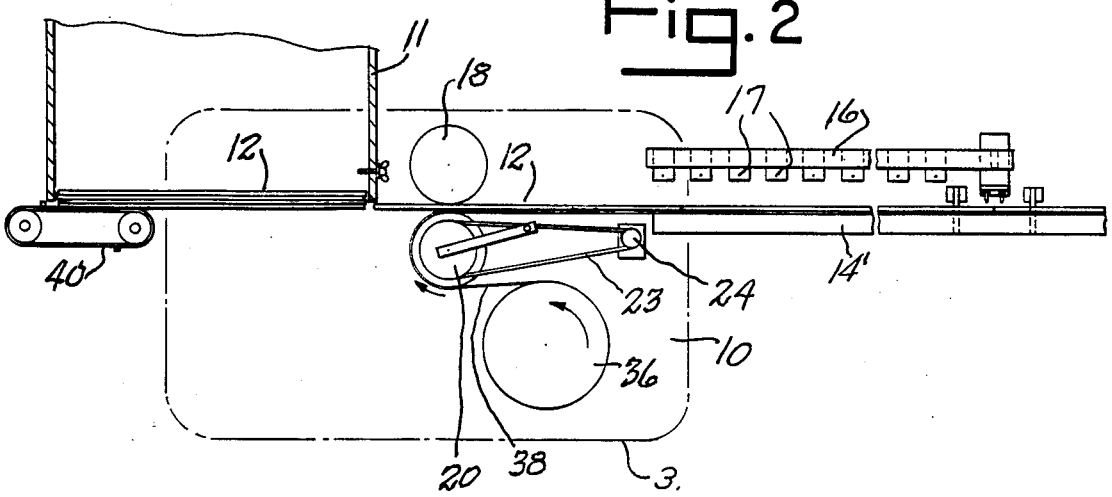
FIG. 2 is a schematic side view of the forming and assembling apparatus.

Referring to the drawings, and particularly to FIGS. 1, 2 and 3 thereof, the numeral 10 designates the frame of apparatus which includes a magazine 11 which houses a stack of panels 12, which are preferably formed of an expanded polystyrene foam or other like material. Frame 10 also includes a table 14 which extends to a packaging station (not shown). Frame 10 also supports means 16 for severing each panel 12 into a desired size.

The means for feeding panels 12 from magazine 11 to table 14 may be manual or automatic. The arrangement is such that each panel 12 will be positioned in edge to edge abutment with other panels 12 upon the table 14. The feed means preferably feeds the lowermost panel 12 successively from magazine 11 to the table 14. As panels 12 are successively advanced to the table 14, they preferably pass under an idler wheel 18. A drive wheel 20 is preferably positioned below idler wheel 18 and has its center vertically aligned with the center of the idler wheel 18. Drive wheel 20 may mount a pulley 21 around which is trained a belt 23 which is also trained around a driving pulley 24 activated by suitable means.

A tape supply roll 36 is journaled in frame 10 adjacent to and below the level of drive wheel 20 and carries a tape web 28. Tape web 28 is preferably of the double-faced adhesive variety and includes a release layer 38 adhered to one face 48. In the preferred embodiment, tape web 28 passes between idler wheel 18 and drive wheel 20 which compresses tape face 46 against panel 12 to adhere the top web to the panels.

As shown in FIG. 2, the advance of panel 12 from magazine 11 to table 14 is controlled by a drive belt 40. Drive belt 40 is adapted for successive intermittent operation in selected timed relation to advance the lowermost panel 12 in magazine 11 into compressive contact between drive wheel 20 and idler wheel 18 where tape web 28 is applied.

The means 16 for severing the spacer panel 12 to form the spacer members 15 preferably includes heating wires 17 which are located in a preset position dependent upon the desired size of the foam members, and which extend transversely across the path of travel of the panel 12. When the severing operation is completed and the severing member 16 is withdrawn vertically above the level of the spacer members 15, drive wheel 20 and drive belt 23 are activated to urge the next panel 12 into position beneath the severing means 16, and to deliver the newly severed members 15 to a packaging station (not shown).

The foam material may be expanded polystyrene, polyethylene, or other spacer plastic material suitable for the intended purpose. Spacer members may be positioned between glass panels or other fragile objects which have been assembled in a container for shipment between a location at which the fragile objects are fabricated and the location at which the fragile objects are to be used. The spacer panels 12 are preferably of uniform thickness in the range of ⅛ inch to 1 inch or more. The panels 12 are of a size determined by the size of the individual severed members 15 which are to be formed. For example, to produce foam spacer members ¾ inch thick by 1½ inches wide and 3 inches long, each foam panel 12 is ¾ inch thick, 3 inches wide, and preferably 36 inches long. The size of the magazine 11 for panels of this size might be 30 inches wide by 36 inches long.

The tape web 28 may be of selected width formed of paper, plastic film or other flexible material which has a first layer 46 of adhesive of high bond properties adhered to one face of the tape web and a second adhesive layer 48 of similar or lower bond properties adhered to the other face of the tape web 28. A release layer 38 is adhered to adhesive layer 48. Release layer 38 constitutes a flexible material which is releasably adhered to the tape web 28 for its entire length and may extend beyond the web at one end. Tape web 28 is preferably of a selected width and is positioned upon the respective carrying roll 36 so as to permit contact of the web with foam panel 12 at a carefully selected location or position on the panel.

The operation of cutting spacer panel 12 to form the desired individual members 15 is critical and is best accomplished by the hot wire method. It is necessary that the cutting operation proceed through the spacer, through the high bond adhesive layer 46, through the tape web 28 and through the low bond adhesive layer 48, but not through the release layer 38. Thus, after the cutting operation, an assembly as illustrated in FIGS. 4 and 5 is produced in which adjacent members 15 are of a size predetermined by the spacing of the hot wires. The release layer 38 thus serves as a carrier or connector of all the individual spacer members 15 so that they may be handled as a group. An example of the manner in which the individual members 15 may be arranged to accommodate compact storage is illustrated in FIG. 6.

Foam members 15 with adhered tape web 28 may be applied readily at selected positions upon a fragile object to be assembled with other objects for shipment. The application of individual spacer members 15 may be accomplished manually or mechanically as by means of a robot. Release layer 38 facilitates advance and successive positioning of spacer members 15 relative to successive fragile objects. Release layer 38 is readily separated from the low bond adhesive 48 which is then exposed to the face of the object to be protected. The adhesive material 48 is selected to facilitate ready separation of the release layer 38 from the tape web 28, but its bonding properties should be from the tape web 28, but its bonding properties should be sufficient to adhere spacer member 15 to the fragile object during its use as a spacer. The bonding properties of adhesive 48 should also be sufficiently low to readily facilitate removal of the foam members 15 and adhered tape web 28 from the fragile object. In other words, the difference in the degree of bonding strength provided by the respective adhesive layers 46 and 48 must be such that the tape web 28 will be adhered to the spacer member when release layer 38 is separated from the tape web 28 and when member 15 and the adhered tape web 28 are being separated from a fragile object.

While the preferred embodiments of the invention have been illustrated and described, it will be understood that changes within the scope of the appended claims may be made without departing from the spirit of the invention.

I claim:

1. A foam member for use as a spacer adjacent a fragile object during storage and shipment, comprising a spacer member of selected dimensions and thickness, a tape adhered to a surface of said member by a first adhesive, a second adhesive applied to said tape at the surface thereof opposite that at which said first adhesive is applied, and a release layer adhered to said second adhesive and serving to connected adjacent spacer members, and a second spacer member of selected dimensions and thickness substantially the same as said first mentioned spacer member, said second spacer member positioned adjacent said first mentioned spacer member, a second tape spaced from said first tape and adhered to a surface of said second spacer member by said first adhesive, said second adhesive applied to said second tape at an opposite surface of said second tape, said release layer being continuous and adhered to said second tape to connect said first and second spacer members.

* * * * *